US006626726B2

(12) United States Patent
Moon et al.

(10) Patent No.: US 6,626,726 B2
(45) Date of Patent: Sep. 30, 2003

(54) METHOD FOR FABRICATING CATHODE STRUCTURE FOR CATHODE RAY TUBE

(75) Inventors: Sung-hwan Moon, Kyungki-do (KR); Ji-hoon Ahn, Kyungki-do (KR); Bu-chul Shin, Kyungki-do (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 390 days.

(21) Appl. No.: 09/741,082

(22) Filed: Dec. 21, 2000

(65) Prior Publication Data

US 2001/0009835 A1 Jul. 26, 2001

(30) Foreign Application Priority Data

Jan. 24, 2000 (KR) ..... 2000-3258

(51) Int. Cl.[7] ..... H01J 9/02; H01J 9/18
(52) U.S. Cl. ..... 445/36; 29/25.15; 29/424
(58) Field of Search ..... 445/36; 29/424, 29/25.15, 25.13

(56) References Cited

U.S. PATENT DOCUMENTS 4,210,988 A * 7/1980 Turnbull et al. ..... 445/36
5,107,583 A * 4/1992 Gustafsson ..... 29/600

* cited by examiner

*Primary Examiner*—Sandra O'Shea
*Assistant Examiner*—Dalei Dong
(74) *Attorney, Agent, or Firm*—Leydig, Voit & Mayer, Ltd.

(57) ABSTRACT

A method for fabricating an indirectly-heated cathode structure including inserting a heater into a mold, injecting a thermoplastic resin into the space of the mold to embed the heater in the thermoplastic resin, inserting the heater embedded in the thermoplastic resin into a sleeve having a cap on an end, connecting the sleeve and the heater using a support body to assemble a cathode structure, and heating the cathode structure to remove the thermoplastic resin from the cathode structure. Therefore, in an indirectly-heated cathode structure, deviation of a heater from a center position in a sleeve can be prevented, and it is easy to adjust the gap between a heater, a sleeve, and a cap. Thus, the heater can be positioned at a desired position inside the sleeve, preventing current leakage due to a breakdown in the heater. In particular, the sleeve and the cap can be uniformly heated, reducing a local difference in thermion emitting density.

3 Claims, 6 Drawing Sheets

METHOD FOR FABRICATING CATHODE STRUCTURE FOR CATHODE RAY TUBE

BACKGROUND OF THE INVENTION

1. Field of the Invention

The present invention relates to a method for fabricating a cathode structure for a cathode ray tube, and more particularly, to a method for fabricating an indirectly-heated cathode structure.

2. Description of the Related Art

An indirectly-heated cathode structure, as shown in FIGS. 1 and 2, is constructed such that a heater 3, which is a heat source, and a cap 1*a* or 1*b*, on which an electron emitting substance 4 is coated or installed, are separated, unlike a directly-heated cathode structure, in which a cathode material is directly heated by a filament.

In detail, a cathode structure shown in FIG. 1 includes a cap 1*a*, a sleeve 2, and a heater 3. The cap 1*a* is coated with a cathode material 4, which is an electron emitting substance, and the cap 1*a* fits over the top end of the sleeve 2, in which the heater 3 is disposed. The heater 3 has a filament 3*a* having a double helix structure coated with a heat-resistant insulating material such as alumina.

The cathode structure shown in FIG. 2 is constructed such that the cap 1*b* is inserted into the top end of the sleeve 2.

In the aforementioned cathode structures, the operating temperature of the cathode is in a range between 700° C. and 900° C. in the case of an oxide cathode material, while the temperature of the cathode is in a higher range between 1400° C. and 1500° C. in the case of a metallic porous body or a metal alloy.

Thus, the metal cathode structure requires a high current because high temperature must be generated by the heater 3. However, the metal cathode structure operating at such a high temperature is liable to cause a leakage current between a heater and a sleeve due to a breakdown in an insulating material 3*b* which protects the filament 3*a*. In particular, when the heater 3 is positioned in the center of the sleeve 2 and is deviated to one side rather than being equally spaced apart from the inner surface of the sleeve 2 and the cap 1*a* or 1*b*, there is a high probability of a breakdown. Also, in the case where the heater 3 is deviated toward one side within the inner space of the sleeve 2, the thermal distribution is not uniform throughout the sleeve 2 and the cap 1*a* or 1*b*, thereby increasing a local difference in the electron emitting density of the electron emitting source.

Therefore, it is very essential that the heater is properly positioned at the center of a sleeve after inserting the heater into the sleeve. However, conventionally, there has been no particular step or measure taken for positioning the heater in the center of the sleeve.

SUMMARY OF THE INVENTION

To solve the above problems, it is an object of the present invention to provide a method for fabricating an indirectly-heated cathode structure which can prevent current leakage from being generated due to a breakdown in a heater by positioning the heater at a desired position on a sleeve.

It is another object of the present invention to provide a method for fabricating an indirectly-heated cathode structure which can reduce a local difference in the thermion emission density by uniformly heating a sleeve and a cap.

Accordingly, to achieve the first object, there is provided a method for fabricating an indirectly-heated cathode structure, including the steps of inserting a heater formed in a predetermined shape into a space of a mold, injecting a thermoplastic resin into the space of the mold to mold the heater by the thermoplastic resin, inserting the heater molded by the thermoplastic resin into a sleeve having a cap on its top end, connecting the sleeve and the heater by means of a support body to assemble a cathode structure, and heating the cathode structure to remove the thermoplastic resin used for molding the heater.

Preferably, the space of the mold is shaped so as to correspond to the inner space of the sleeve. In particular, a protrusion for a spacer, locally contacting the sleeve, for positioning the heater at a desired position of the inner space of the sleeve, is preferably provided on the outer surface of a thermoplastic resin for molding the heater.

BRIEF DESCRIPTION OF THE DRAWINGS

The above objects and advantages of the present invention will become more apparent by describing in detail a preferred embodiment thereof with reference to the attached drawings in which.

DESCRIPTION OF THE PREFERRED EMBODIMENT

An indirectly-heated cathode structure according to an embodiment of the present invention will be described in detail with reference to the accompanying drawings.

Figure 1:
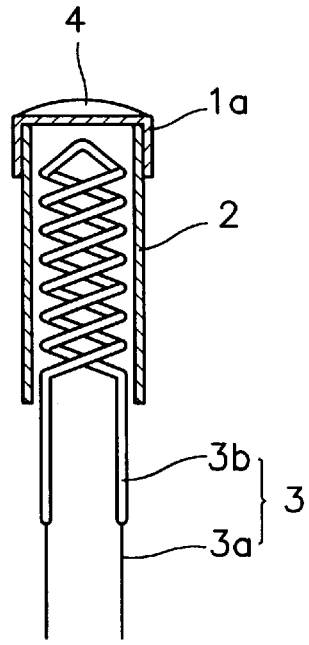
FIG. 1 (PRIOR ART)
FIGS. 1 and 2 are schematic sectional views illustrating conventional indirectly-heated cathode structures.
Figure 2:
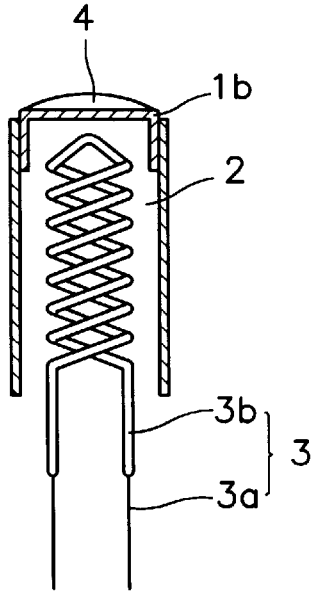
FIG. 2 (PRIOR ART)
Figure 3A:
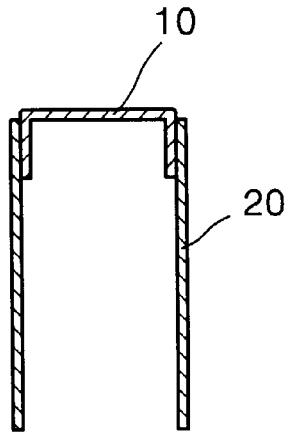
FIG. 3*a* is a sectional view of a sleeve employed in a method for fabricating an indirectly-heated cathode structure according to the present invention.
Figure 3B:
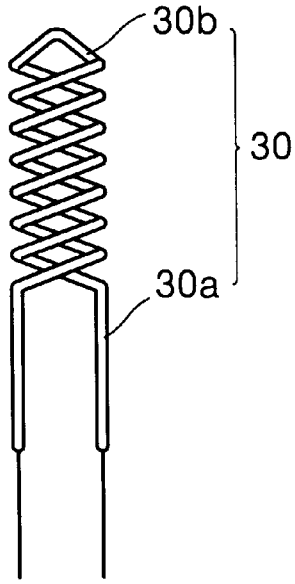
FIG. 3*b* is a side view of a heater employed in a method for fabricating an indirectly-heated cathode structure according to the present invention.

As shown in FIGS. 3*a* and 3*b*, a sleeve 20 having a cap 10 connected to its upper end and a heater 30 accommodated therein are prepared. The heater 30 is produced by forming a filament 30*a* in a helix structure, and forming an insulating layer 30*b*, such as alumina, on the surface of the formed filament 30*a* by electrodeposition.

Figure 4:
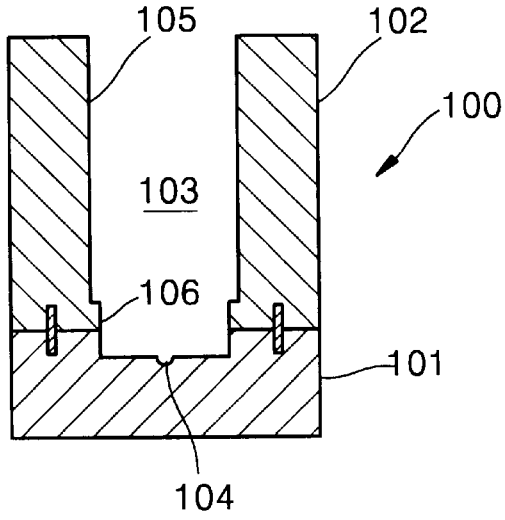
FIG. 4 is a schematic sectional view of a mold employed in a method for fabricating an indirectly-heated cathode structure according to the present invention.

As shown in FIG. 4, a mold 100 having a cavity 103 corresponding to the inner space of the sleeve 20 is prepared. The mold 100 consists of an upper part 102 and a lower part 101, and the cavity 103 is provided thereby. The maximum diameter of the cavity 103 is substantially equal to the inner diameter of the sleeve 20, but it is preferably slightly smaller. A groove 104 facing the center of the inner surface of the cap 10 is formed on the bottom of the cavity 103. A large diameter portion 105 substantially equal to the inner diameter of the sleeve 20 and a small diameter portion 106 are provided at the upper portion of the mold 100.

Figure 5:
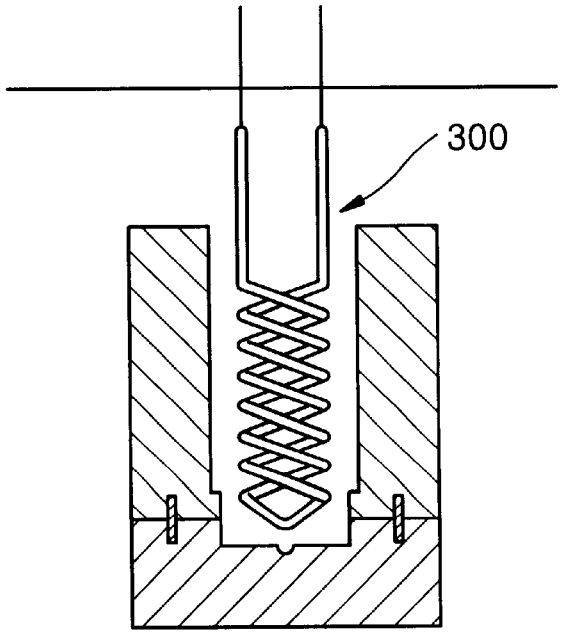
FIG. 5 illustrates a state in which the heater is embedded in the mold in the method for fabricating an indirectly-heated cathode structure according to the present invention.

As shown in FIG. 5, the upside-down heater 30 is inserted into the cavity 103 of the mold 100 and positioned at the center of the cavity 103.

Figure 6:
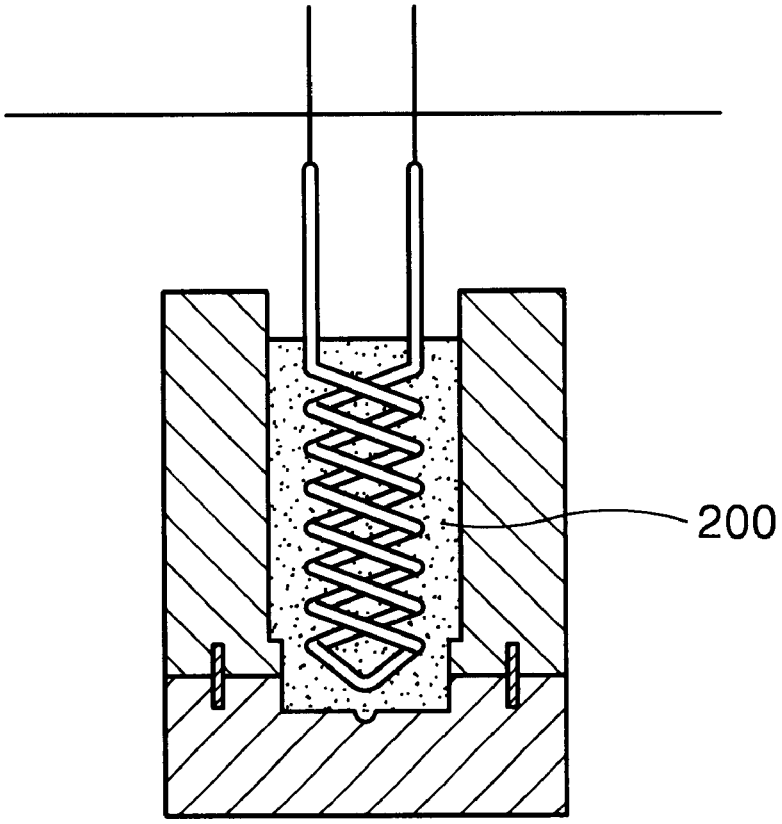
FIG. 6 illustrates a state in which a thermoplastic resin is injected into the mold into which the heater is embedded in the method for fabricating an indirectly-heated cathode structure according to the present invention.

As shown in FIG. 6, a thermoplastic resin 200 is injected into the cavity 103 of the mold 100 and hardened.

Figure 7:
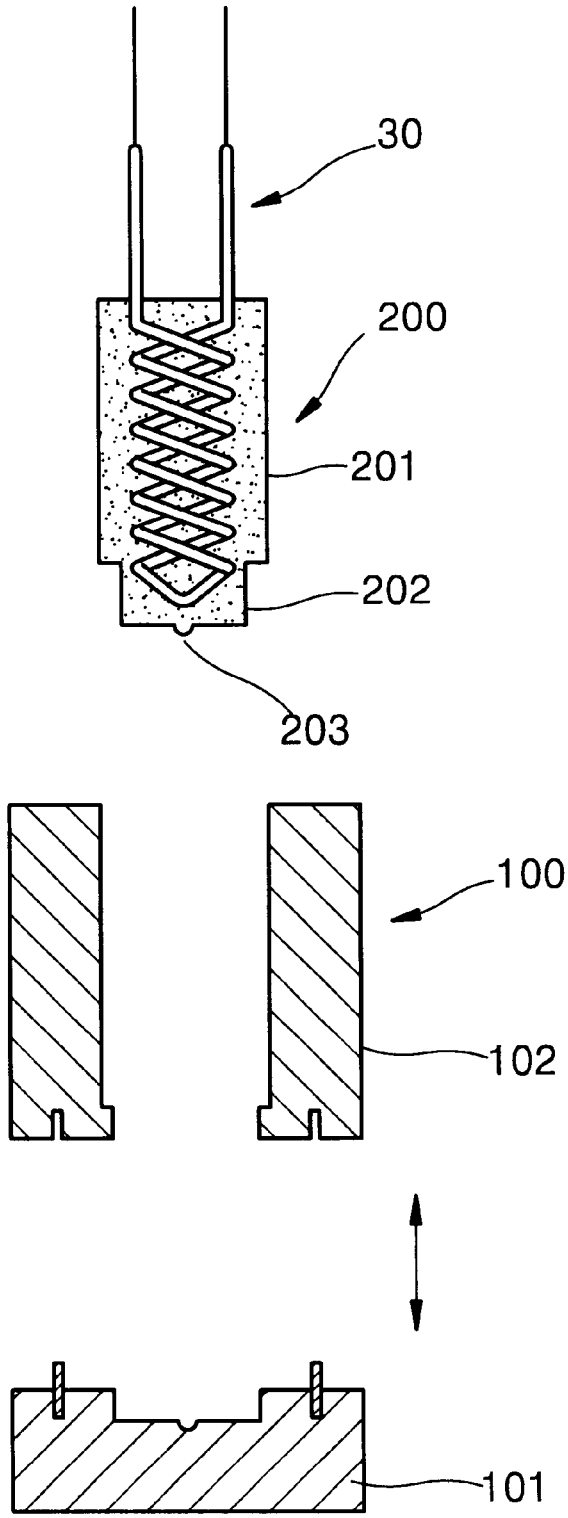
FIG. 7 illustrates a state in which the heater molded with the thermoplastic resin is separated from the mold in the method for fabricating an indirectly-heated cathode structure according to the present invention.

As shown in FIG. 7, the heater 30 molded with the thermoplastic resin 200 is separated from the mold 100. The thermoplastic resin 200 surrounding the heater 30 has dimensions that allow it to fitted into the sleeve 20. In particular, there is provided a large diameter portion 201 locally contacting the inner surface of the sleeve 20, a small diameter portion 202 and a protrusion 203 contacting the center of the inner surface of the cap 10 connected to the upper end of the sleeve 20.

Figure 8:
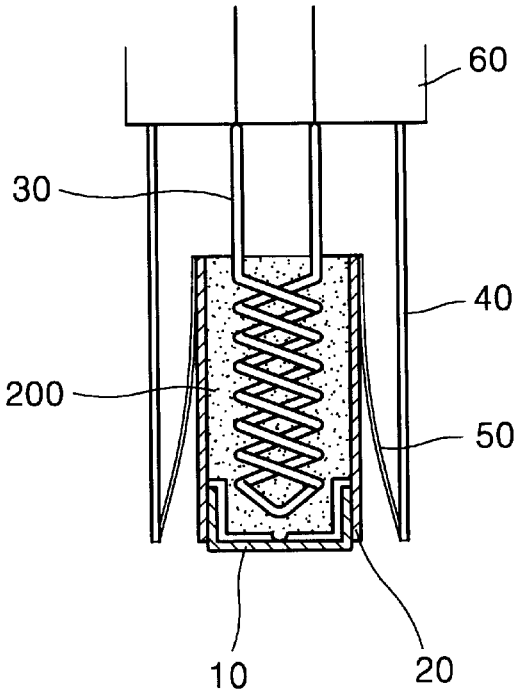
FIG. 8 illustrates a state in which the heater molded with the thermoplastic resin is inserted into the sleeve to be supported in a support body by the method for fabricating an indirectly-heated cathode structure according to the present invention.

As shown in FIG. 8, the heater 30 is inserted into the sleeve 20, and the sleeve 20 is suspended in a protective tube 40 by a ribbon 50, and these elements are fixed to a support body 60. The heater 30 molded by the thermoplastic resin 200 is centrally positioned inside the sleeve 20. Here, the heater 30 is fixed relative to the sleeve 20 by the support body 60 for supporting the elements.

Figure 9:
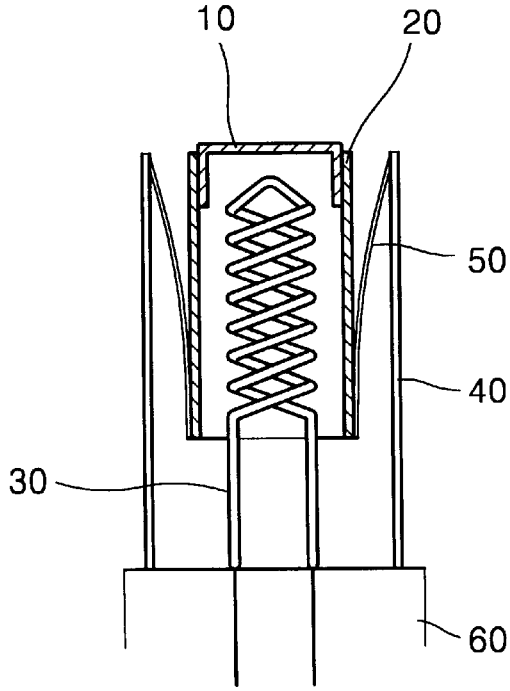
FIG. 9 illustrates a state in which the thermoplastic resin is removed in a state such that the heater is fixed by the support body relative to the sleeve in the method for fabricating an indirectly-heated cathode structure according to the present invention.

As shown in FIG. 9, the thermoplastic resin 200 is removed to leave only the heater 30 inside the sleeve 20. By removing the thermoplastic resin 200, the heater 30 is positioned precisely at the center of the sleeve 20 without being deviated to one side.

Then, according to a conventional process, a thermion emitting source is applied to or fixed to the top surface of the cap 10, thereby providing a completed indirectly heated cathode structure.

As described above, according to the method for fabricating an indirectly heated cathode structure of the present invention, a thermoplastic resin is employed as a spacer for determining the position of a heater. If the position of the heater relative to the sleeve is fixed, since the thermoplastic resin serving as a spacer is not further necessary, it is removed by applying heat.

According to the present invention, in an indirectly-heated cathode structure, a heater deviating from center can be prevented, and it is easy to adjust the gap between a heater, a sleeve and a cap. Thus, the heater can be positioned at a desired position inside the sleeve, thereby preventing current leakage from being generated due to a breakdown in the heater. In particular, the sleeve and the cap can be uniformly heated, thereby reducing a local difference in the thermion emitting density.

While the present invention has been described in conjunction with a preferred embodiment disclosed, which is presented for illustrative purposes only, various changes and equivalent embodiments may be made by those skilled in the art without departing from the spirit and scope of the appended claims. It is therefore contemplated that the true scope of the invention be set forth in the following claims.

What is claimed is:

1. A method for fabricating an indirectly-heated cathode structure including a heater disposed within and spaced from a sleeve closed at one end by a cap coated with an electron emitting material, the heater including a helical coil and leads extending from the helical coil, the method comprising:

placing the helical coil of the heater within an internal space of a mold, the internal space of the mold corresponding to an internal space of the sleeve and including a first part having a first diameter substantially equal to an inner diameter of the sleeve and a second part having a second diameter smaller than the first diameter;

injecting a thermoplastic resin into the internal space of the mold, thereby completely encapsulating the helical coil in the thermoplastic resin;

removing the thermoplastic resin encapsulating the helical coil from the mold and inserting the thermoplastic resin encapsulating the helical coil into the sleeve;

assembling a cathode structure by connecting the sleeve and the leads of the heater to a support body; and heating the cathode structure and thereby removing the thermoplastic resin from the cathode structure.

2. The method according to claim 1, wherein the mold includes a groove on a bottom surface in the mold, and including injecting the thermoplastic resin into the internal space of the mold and filling the groove, forming a protrusion on an end of the thermoplastic resin encapsulating the helical coil, and inserting the thermoplastic resin encapsulating the helical coil into the sleeve so that the protrusion contacts the cap, thereby providing a space between at least the cap and a part of the thermoplastic resin encapsulating the helical coil.

3. A method for fabricating an indirectly heated cathode structure including a heater disposed within and spaced from a sleeve closed at one end by a cap coated with an electron emitting material, the heater including a helical coil and leads extending from the helical coil, the method comprising:

placing the helical coil of the heater within an internal space of a mold, the mold having a bottom surface including a groove;

injecting a thermoplastic resin into and filling the internal space of the mold, including the groove, thereby encapsulating the helical coil in the thermoplastic resin and forming a protrusion at an end of the thermoplastic resin;

removing the thermoplastic resin encapsulating the helical coil from the mold and inserting the thermoplastic resin encapsulating the helical coil into the sleeve so that the protrusion contacts the cap, spacing part of the thermoplastic resin from the cap;

assembling a cathode structure by connecting the sleeve and the leads of the heater to a support body; and heating the cathode structure and thereby removing the thermoplastic resin from the cathode structure.

* * * * *